US012759781B2

(12) United States Patent
Palm et al.

(10) Patent No.: US 12,759,781 B2
(45) Date of Patent: Oct. 13, 2026

(54) REFILL PACKAGE CONTAINING A PRODUCT

(71) Applicant: The Clorox Company, Oakland, CA (US)

(72) Inventors: Matthias Palm, Pleasanton, CA (US); Kerry Azelton, Pleasanton, CA (US); Li Zhang, Pleasanton, CA (US)

(73) Assignee: THE CLOROX COMPANY, Oakland, CA (US)

( * ) Notice: Subject to any disclaimer, the term of this patent is extended or adjusted under 35 U.S.C. 154(b) by 0 days.

(21) Appl. No.: 18/810,950

(22) Filed: Aug. 21, 2024

(65) Prior Publication Data

US 2025/0066101 A1 Feb. 27, 2025

Related U.S. Application Data

(60) Provisional application No. 63/578,167, filed on Aug. 23, 2023.

(51) Int. Cl.

| | |
|---|---|
| ***B65D 81/22*** | (2006.01) |
| ***B65D 81/20*** | (2006.01) |
| ***B65D 83/08*** | (2006.01) |
| ***B65D 85/62*** | (2006.01) |

(52) U.S. Cl.

CPC ..... *B65D 81/2007* (2013.01); *B65D 81/22* (2013.01); *B65D 83/0805* (2013.01)

(58) Field of Classification Search

CPC ..... B65D 81/2007; B65D 81/22; B65D 83/0805; B65D 2203/02; B65D 75/323; B65D 75/527; B65D 81/2023; B65D 85/62

USPC ..... 206/389, 391–394, 494, 524.8

See application file for complete search history.

(56) References Cited

U.S. PATENT DOCUMENTS 4,564,108 A * 1/1986 Widlund ..... B65D 33/008 206/820
5,464,096 A * 11/1995 Hurwitz ..... B08B 1/143 206/812
6,161,695 A * 12/2000 Nicolais ..... A61F 2/0095 206/524.8
6,736,266 B2 * 5/2004 Flaig ..... A61K 8/733 206/823

(Continued)

FOREIGN PATENT DOCUMENTS

GB 2492413 A 1/2013

OTHER PUBLICATIONS

Notification of Transmittal of International Search Report and Written Opinion including International Search Report and Written Opinion for International Application No. PCT/US2024/043201 dated Dec. 9, 2024, 12 pages.

*Primary Examiner* — Luan K Bui
(74) *Attorney, Agent, or Firm* — Edell, Shapiro & Finnan, LLC

(57) ABSTRACT

A vacuum sealed package contains a rolled or stacked product and a liquid in the package. The vacuum sealing of the package reduces the overall size of the package and ensures the liquid is retained in the package, thereby facilitating transportation or shipment of the product. As a result, when a user opens a vacuum sealed package, the rolled or stacked product in the package contains most of the liquid in the package and is not dried out. The vacuum sealed package can be referred to alternatively as a refill or replacement package.

17 Claims, 15 Drawing Sheets

(56) References Cited

U.S. PATENT DOCUMENTS

| | | | | |
|---|---|---|---|---|
| D771,489 | S | 11/2016 | Azelton et al. | |
| D773,930 | S | 12/2016 | Azelton et al. | |
| 9,974,419 | B2 | 5/2018 | Azelton et al. | |
| 10,327,602 | B2 | 6/2019 | Azelton et al. | |
| 10,806,309 | B2 | 10/2020 | Azelton et al. | |
| 11,439,281 | B2 | 9/2022 | Azelton et al. | |
| 2004/0168947 | A1* | 9/2004 | McDonald | B65D 85/07 206/494 |
| 2004/0176735 | A1* | 9/2004 | Snell | A61F 13/84 206/438 |
| 2005/0085781 | A1* | 4/2005 | Corlett | A61F 13/55115 604/385.02 |
| 2005/0155896 | A1 | 7/2005 | Snell | |
| 2008/0110920 | A1* | 5/2008 | Hlista | B65D 83/0841 221/45 |
| 2008/0134638 | A1* | 6/2008 | Corlett | B65B 31/00 53/436 |

* cited by examiner

REFILL PACKAGE CONTAINING A PRODUCT

CROSS-REFERENCE TO RELATED APPLICATION

This application claims priority to and the benefit of U.S. Provisional Patent Application No. 63/578,167, filed Aug. 23, 2023, entitled "Refill Package Containing a Product," with the entire disclosure of which is incorporated by reference herein in its entirety.

FIELD OF THE INVENTION

The present invention is directed generally to a package that contains a nonwoven product, and more specifically, to a vacuum sealed package that contains a fibrous web or nonwoven rolled or folded product.

BACKGROUND

Nonwoven rolled and folded products are well known. In some instances, a nonwoven rolled or folded product may include a liquid that has particular characteristics and properties, such as for cleaning or disinfecting a surface. Some nonwoven rolled or folded products include a plurality of interconnected sheets or wipes. Current rolled or folded products are dispensed from a canister or container which is discarded once a user utilizes all of the nonwoven rolled or folded product therein.

There is a need to facilitate the reuse of canisters that contain nonwoven rolled or folded products. There is also a need to reduce the amount of material used, and the amount of space needed, to transport a certain quantity of a nonwoven rolled or folded product that includes a liquid. In addition, there is a need for a replacement or refill package of nonwoven rolled or folded product that includes a liquid that can be used easily with an existing canister or container that no longer has any nonwoven rolled or folded product therein.

SUMMARY

The present invention relates to a package that contains a product. In one embodiment, the product can be a rolled or folded product. In various embodiments, the rolled or folded product can be any type of rolled or folded product, and is not limited to a nonwoven product. In one embodiment, the nonwoven rolled or folded good or product includes a liquid, and is a roll or folded pack of cleaning or disinfecting wipes.

The package according to the present invention is a vacuum sealed package containing a rolled or folded product and a liquid in the package. The vacuum sealing of the package reduces the overall size of the package and ensures the liquid is retained in the package, thereby facilitating transportation or shipment of the product. As a result, when a user opens a vacuum sealed package, the rolled or folded product in the package contains most of the liquid in the package and is not dried out. The vacuum sealed package can be referred to alternatively as a refill or replacement package.

The rolled or folded product and liquid in a package can be removed easily from the package and inserted into a canister for subsequent dispensing and use. It is also possible to partially open the vacuum package and insert the "refill" rolled or folded good into the canister and dispense out of the canister even if the partially opened vacuum sealed package is also in the canister. Thus, a user can reuse a canister that no longer has any rolled or folded product and/or liquid therein by inserting a rolled or folded product and liquid from a vacuum sealed package into the empty canister. As a result, fewer dispensing containers are needed because of the refill package according to the present invention. That reusability of a canister and the refillable packages reduce the overall use of material (fewer dispensing containers) used to dispense multiple rolls or folded packs of nonwoven product. In addition, the refillable packages reduce the space needed to ship a certain amount of liquid or composition (previously each dispensing container only included a single rolled product and its liquid), reduces the quantity of shipping pallets used, and reduces the quantity of transportation vehicles needed.

In one embodiment according to the present disclosure, a flexible package comprises a body defining a cavity under vacuum pressure of about 5 to 800 mbar at room temperature, the body having a seal, a product disposed in the cavity, the product containing multiple nonwoven substrates, and a formula disposed in the cavity with the multiple nonwoven substrates, wherein the seal of the body can be opened to access the product and the formula, and the product and the formula.

In an alternative embodiment, the product is multiple nonwovens in a shape of a roll. In another embodiment, the product is a roll of disinfecting and/or cleaning wipes. In another embodiment, the body is a thermoform-shaped film package. In an alternative embodiment, the body includes a first material layer and a second material layer, the first material layer being thermoformed to define the cavity. In yet another embodiment, the product is multiple nonwovens in a layered stack.

In another embodiment according to the present disclosure, a flexible package comprises a first body defining a first cavity under vacuum pressure of about 5 to 800 mbar at room temperature, the first body having a seal, a first product disposed in the first cavity wherein the first product contains multiple nonwoven substrates, a first formula disposed in the first cavity with the multiple nonwoven substrates, a second body defining a second cavity under vacuum pressure of about 5 to 800 mbar at room temperature, the second body having a seal, a second product contains multiple nonwoven substrates disposed in the second cavity of the second body, and a second formula disposed in the second cavity of the second body, wherein the seal of the first body or the second body can be opened to access the first product or the second product, respectively, and the first body and the second body are connected to each other with perforations that can be separated by a user.

In another embodiment, the first body has a first edge, the second body has a second edge, and the second edge is connected to the first edge by the perforations. In yet another embodiment, the first product is multiple nonwovens in a layered stack. In one embodiment, the first product is a roll of disinfecting and/or cleaning wipes. In yet another embodiment, the first product is multiple nonwovens in a shape of a roll. In one embodiment, the first product is a roll of disinfecting and/or cleaning wipes. In an alternative embodiment, the first body and the second body are a thermoform-shaped film package.

In another embodiment according to the present disclosure, a package of a first product and a second product comprises a first package portion including a first body defining a first cavity under vacuum pressure of about 100 to 800 mbar at room temperature, the first body having a first perimeter extending around the first body, the first body having a first seal extending around the first perimeter, and a first product and a first formula, each of the first product and the first formula disposed in the first cavity, the first seal being openable to access the first product and the first formula, and a second package portion including a second body defining a second cavity under vacuum pressure, the second body having a second perimeter extending around the second body, the second body having a second seal extending around the second perimeter, and a second product and a second formula, each of the second product and the second formula disposed in the second cavity, the second seal being openable to access the second product and the second formula, wherein the second package portion is connected to the first package portion via perforations that can be separated by a user, and one of the first seal or the second seal can be opened without opening the other of the first seal or the second seal.

In an alternative embodiment, each of the first product and the second product is one of a fibrous web or a continuous nonwoven product. In another embodiment, each of the first product and the second product is a roll of disinfecting and/or cleaning wipes. In yet another embodiment, each of the first body and the second body is a thermoform-shaped film package. In an alternative embodiment, the first body includes a first material layer and a second material layer, the first material layer being thermoformed to define the first cavity. In another embodiment, the first product and the second product are multiple nonwovens in a layered stack. In yet another embodiment, the first body has a first edge, the second body has a second edge, and the second edge is connected to the first edge by the perforations.

DETAILED DESCRIPTION

The present invention is described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

Figure 1:
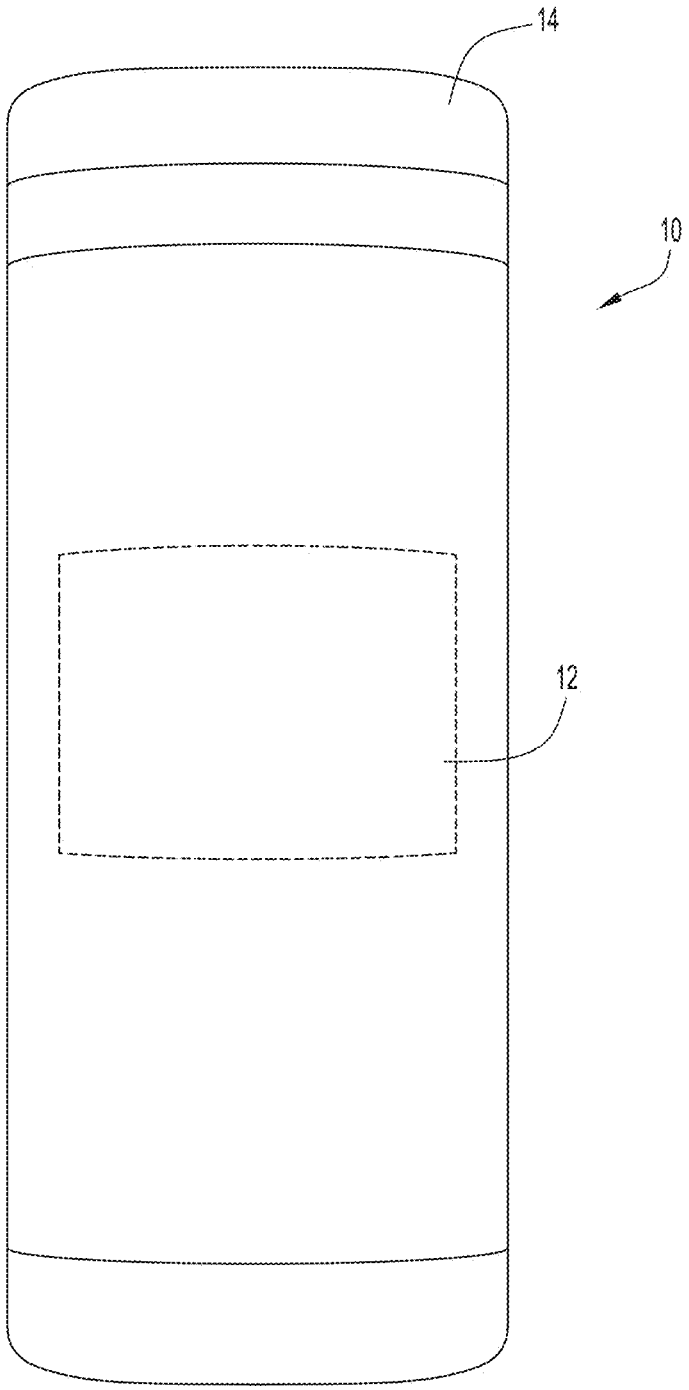
FIG.1 (PRIOR ART)
FIG. 1 is a front view of an exemplary conventional dispensing container.

Referring to FIG. 1, a front view of an exemplary conventional canister is illustrated. The canister can be referred to alternatively as a container. The canister 10 includes a housing or body 12 and a removable lid 14 that can be coupled to the housing 12. The lid 14 can be opened or closed to control access to the interior of body 12 and any product located in the body 12 of the canister 10. The housing may be a soft or substantially rigid material. In one embodiment, the lid is more rigid than the housing material so that the housing material may flex to connect to the lid to form a sealed container. To make the lid more rigid than the housing material the thickness of material used for the lid may be greater than the thickness of the material for the housing. In addition, the lid may be formed by an injection molding process whereas the housing may be formed using a blow molding process.

Exemplary canisters having different features are disclosed in the following patents: U.S. Design Pat. No. D771,489, issued Nov. 15, 2016, entitled "Wipes Dispenser Container Lid"; U.S. Design Pat. No. D773,930, issued Dec. 13, 2016, entitled "Lid With An Orifice"; U.S. Pat. No. 9,974,419, issued May 22, 2018, entitled "Disinfecting Wipes Dispenser"; U.S. Pat. No. 10,327,602, issued Jun. 25, 2019, entitled "Disinfecting Wipes Dispenser"; U.S. Pat. No. 10,806,309, issued Oct. 20, 2020, entitled "Disinfecting Wipes Dispenser"; and U.S. Pat. No. 11,439,281, issued Sep. 13, 2022, entitled "Disinfecting Wipes Dispenser". The entire disclosure of each of the six patents identified in this paragraph is incorporated herein by reference in its entirety for all purposes.

Figure 2:
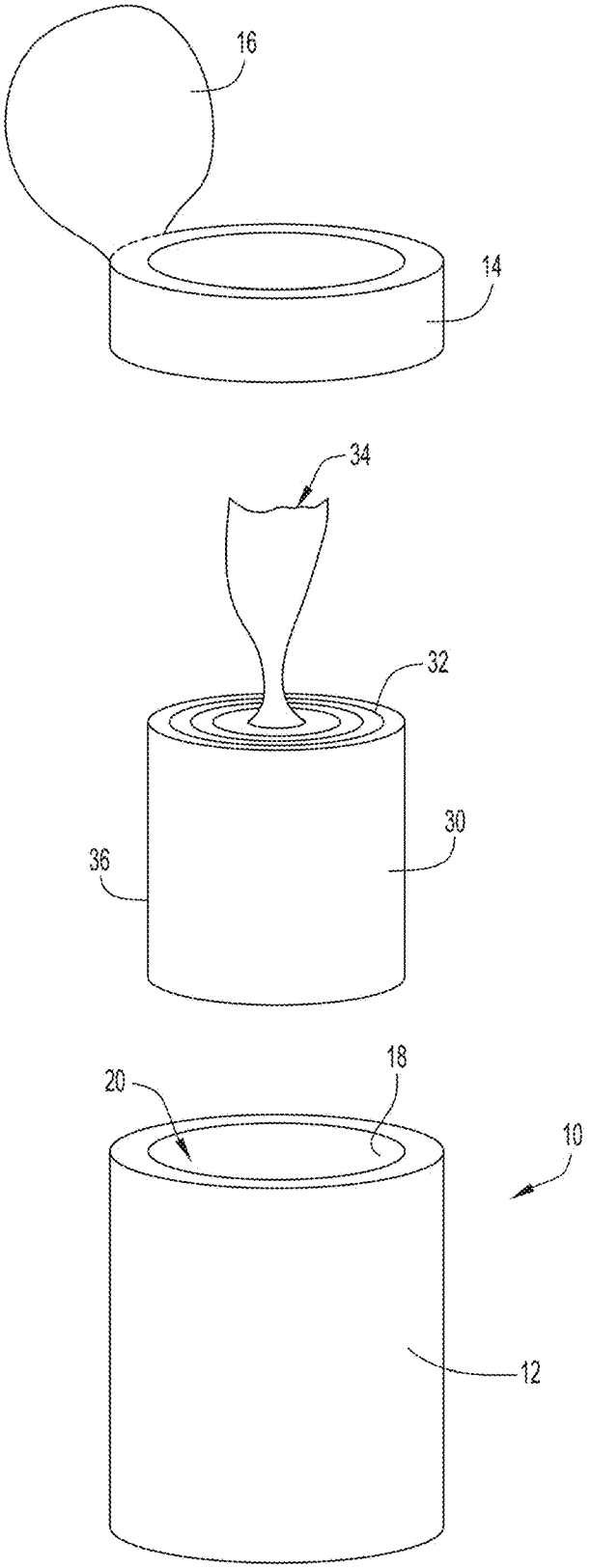
FIG.2 (PRIOR ART)
FIG. 2 is an exploded front perspective view of the conventional dispensing container illustrated in FIG. 1.
Figure 3:
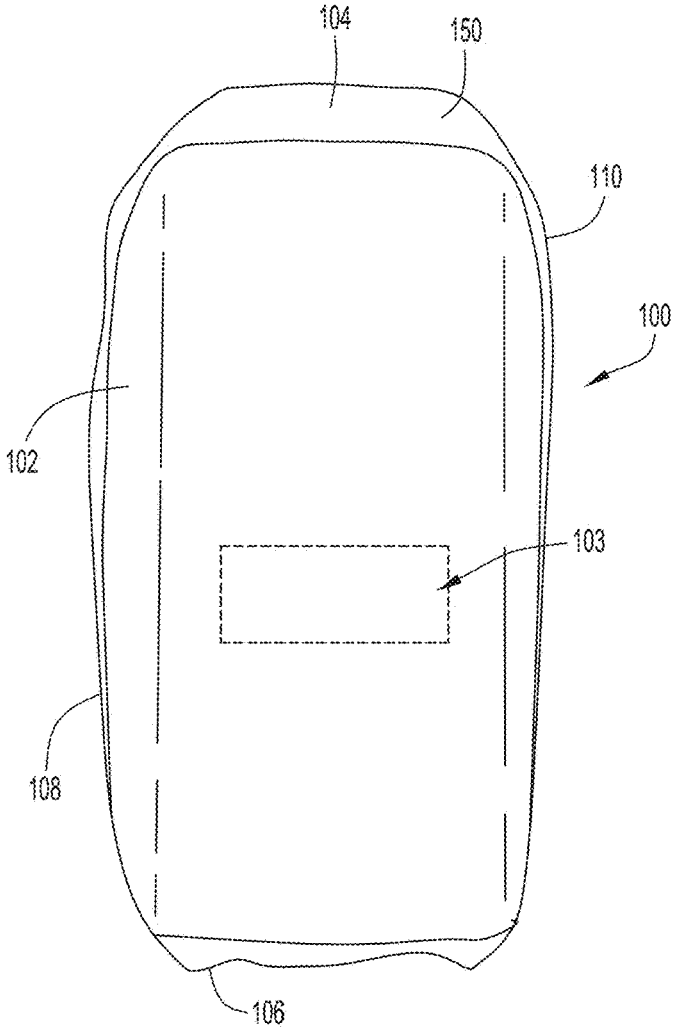
FIG. 3 is a top view of an embodiment of a package containing a rolled product according to the present invention.

FIG. 2 is an exploded front perspective view of the conventional canister 10 and an exemplary product that can be located in the canister 10. The body 12 of the canister 10 includes a wall with an inner surface 18 that defines an interior region or receptacle 20. A product 30 can be inserted into the interior region 20. Typically, the product 30 is a rolled product that is inserted into the canister 10 prior to the canister 10 being transported. A user can access the product 30 in the canister 10 through the lid 14 when the closure element 16 of the lid 14 is opened. In different embodiments, the shape and configuration of the lid 14 can vary.

In one embodiment, the product 30 is a continuous rolled product that includes several layers 32 and an outer perimeter 36. The outer perimeter 36 is sized so that the product 30 can fit within the receptacle 20 of the canister 10. The product 30 includes an end 34 that can be grasped and pulled by a user to remove a portion of the product 30 from the container 10. In the illustrated embodiment, the product 30 is a continuous nonwoven rolled product, such as a roll of disinfecting or cleaning wipes.

As mentioned above, the canister can be shipped with a rolled product 30 located therein. When a user has utilized all of the rolled product 30 in a canister 10, the user recycles or disposes of the empty canister 10. If additional rolled products are desired, the user purchases another canister that has a new rolled product therein. Thus, for a user to access additional rolled products, another canister with a new rolled product has to be manufactured, shipped, and sold to the user.

The present invention relates to a refill or replacement package of a rolled product. The rolled product can be a continuous nonwoven rolled product. In one embodiment, the rolled product is a roll of disinfecting and/or cleaning wipes. The roll of the wipes is formed in a donut roll or cylindrical shaped configuration. The product is sealed in a thermoform shaped film package and transported. In one exemplary manufacturing process, the product is disposed in a horizontal form or orientation, and then a package is filled and sealed. During manufacturing, the package is vacuum scaled during the filling process to eliminate air in the package and compress the rolled product. The cavity containing the rolled product and formula has a pressure range of about 5 to 800 mbar at room temperature. The compression step makes the insertion of the rolled product into an existing canister easy. In addition, the compressed rolled product uses less space during transportation as it is shipped as a refill. The vacuum scaled package also allows for shipping in any orientation without any secondary packaging. The cylindrical canisters with rolls of wipes were originally designed to be shipped in a pallet which allowed them to maintain a set orientation as they were transported. Now more products are being sold on a single unit basis it is more important that the products are capable of being shipped in any orientation without leaking or requiring additional secondary packaging to ensure that any liquid or moisture doesn't leak out during shipment.

In one embodiment, the package is formed of multiple layers of plastic material or film. The package includes a frangible seal that can be opened by the user. Once the frangible seal is opened, the product can be placed into a canister as a refill product. In another embodiment, the package may be one or more layers of plastic material or film. The package includes a perforation or weakened portion of the plastic material where the package may be ripped open or torn open and the opened package may be placed into a refillable canister or tub.

Alternatively, a canister can be manufactured and sold to a user with a package according to the present invention located inside of the canister. The vacuum sealed package located in the canister enables a leak tight package of the product for shipment. Since the package is vacuum sealed, it is also more compact and takes up less space during shipment than a traditional canister or even an alternative wipe refill product that is not vacuum sealed. In one example embodiment, the percentage reduction in size is about 20% to 40% depending on the level of vacuum that is used. Thus, the benefit of the vacuum sealed package is that a larger quantity of wipes from a vacuum sealed package can be fit into a canister than the quantity of non-vacuum sealed wipes.

In alternative embodiments, different sized refills can be manufactured. For example, between 10 and 500 wipes, or 20 and 250 wipes, or 30 and 150 wipes can be included in a package. In a different embodiment, either less or more wipes than that range may be included. Also, in alternative embodiments, the quantity of packages manufactured can vary. For example, each package containing a rolled product can be manufactured separately from each other. Alternatively, multiple packages can be formed together and provided with perforations that can be separated by a user.

Turning to FIGS. 3-6, an exemplary embodiment of a package containing a rolled product according to the present invention is discussed. In this embodiment, the package 100 is a replacement or refill product that can be used with a canister, such as canister 10. Package 100 has a body 102 made of multiple plastic layers or film, at least one of which includes indicia 103 thereon. Indicia 103 relates to the contents of the package 100, namely, the rolled product and liquid or formula therein. The indicia 103 on the package 100 can be either pre-printed on a layer of film or printed directly onto the product during the product filling process.

In this embodiment, the contents of the package 100 is a continuous fibrous web or nonwoven rolled product containing a formula. The fibrous web may include woven or nonwoven materials, including but not limited to, cellulose fibers, modified cellulosic fibers (e.g., rayon, lyocell, etc.), polyethylene, polypropylene, PET, PLA, bicomponent, and other suitable natural or synthetic fibers and filaments, and any combinations or mixtures thereof. The product includes wipes that are rolled into a donut roll or cylindrical shape. The indicia 103 relate to the composition of the formula and the properties of the product, such as its effectiveness.

Figure 4:
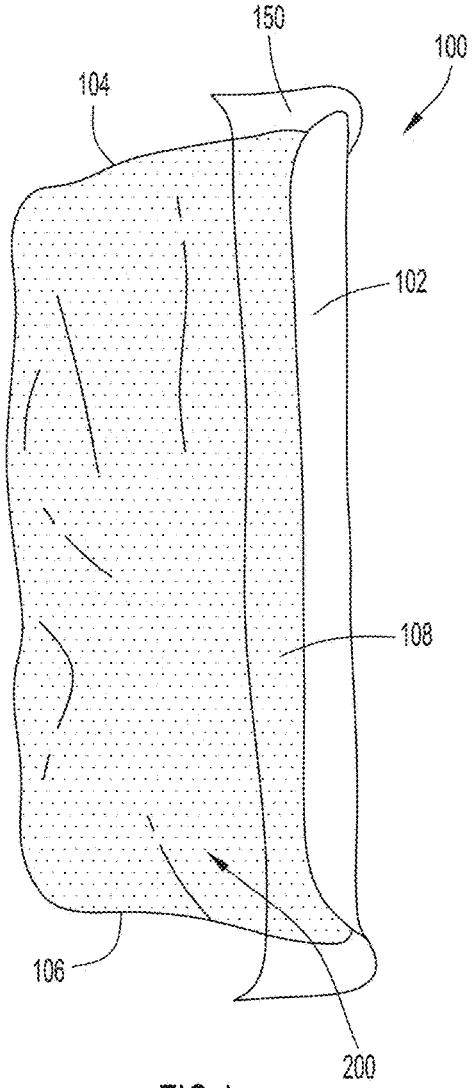
FIG. 4 is a side view of the package illustrated in FIG. 3.
Figure 5:
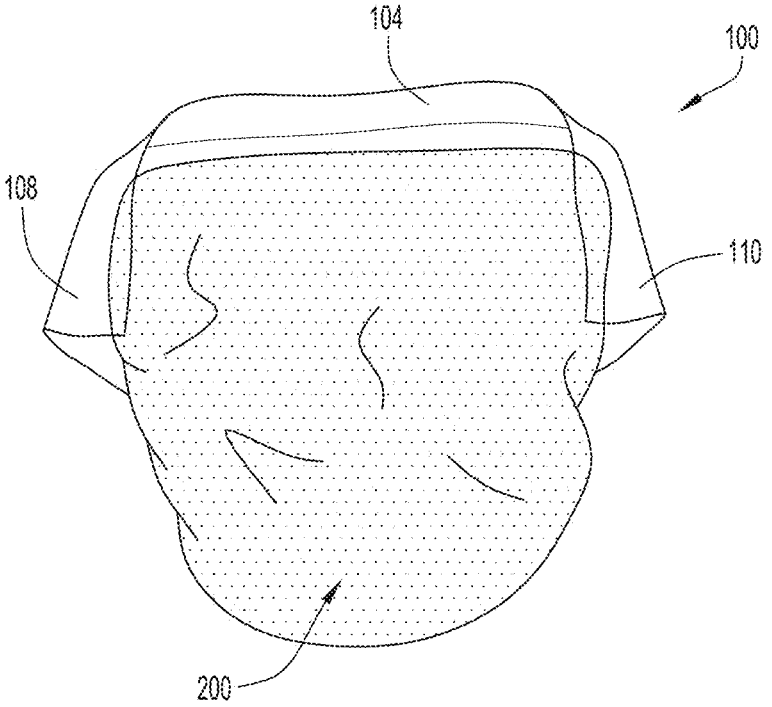
FIG. 5 is an end view of the package illustrated in FIG. 3.
Figure 6:
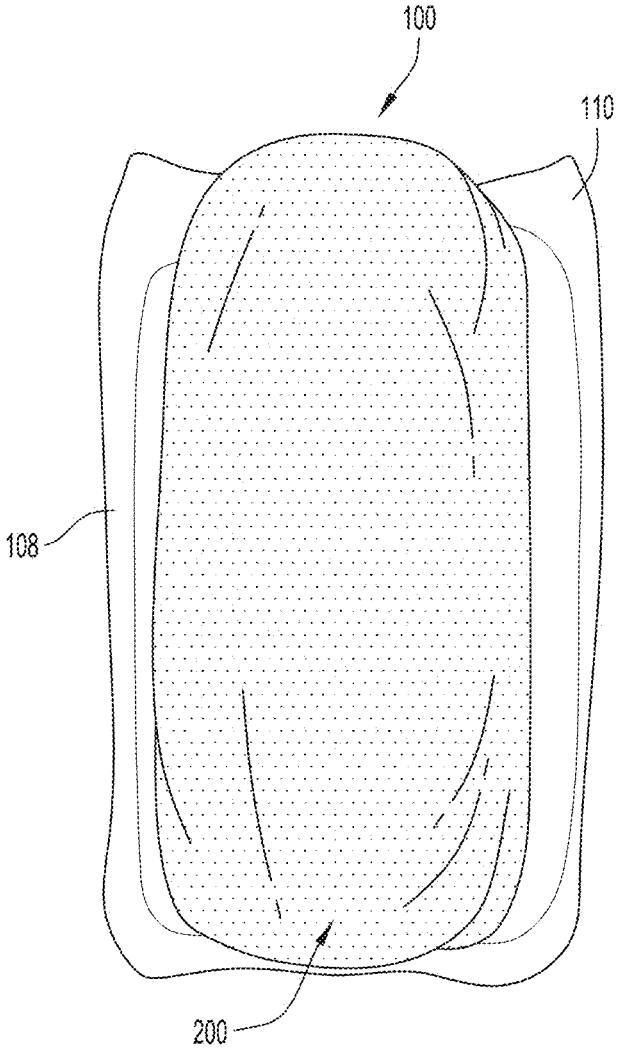
FIG. 6 is a bottom view of the package illustrated in FIG. 3.

The body 102 of the package 100 includes opposite ends 104 and 106, and opposite sides 108 and 110. Proximate to end 104 is a frangible seal 150 that can be opened by a user to access the product within the package 100. In FIGS. 4-6, the product 200, which is a rolled product, located inside of the package 100 is viewable.

Turning to the use of the package 100, a user can refill a canister with an additional rolled product or wipes 200 in different ways. A first exemplary refilling process involves the frangible seal 150 to be opened and the package 100, including the plastic material layers, the product 200, and liquid, inserted into the cavity of the canister. An end of the rolled product 200 can be located by the user and positioned proximate to the lid of the canister. In one embodiment, the wipes may be pulled out of the center of the donut roll. In another embodiment, the wipes may be pulled from the exterior of the donut roll. The user can pull on one of the ends of the rolled product 200 to unwind a portion of the product so the user can separate one or more sections of the rolled product 200 for use. A second exemplary refilling process involves the frangible seal 150 being opened, a portion of each of the material layers being separated, and the product 200 and liquid being removed from the material layers, and positioned in the cavity of the canister. A user can grasp an end of the product 200 as described above.

The refill or replacement packages according to the present invention can be manufactured as individual packages or as multiple connected packages. Individual packages can be cut and separated during the filling or manufacturing process. Multiple connected packages can be connected with one or more perforations for easy separation later by a user.

Figure 7:
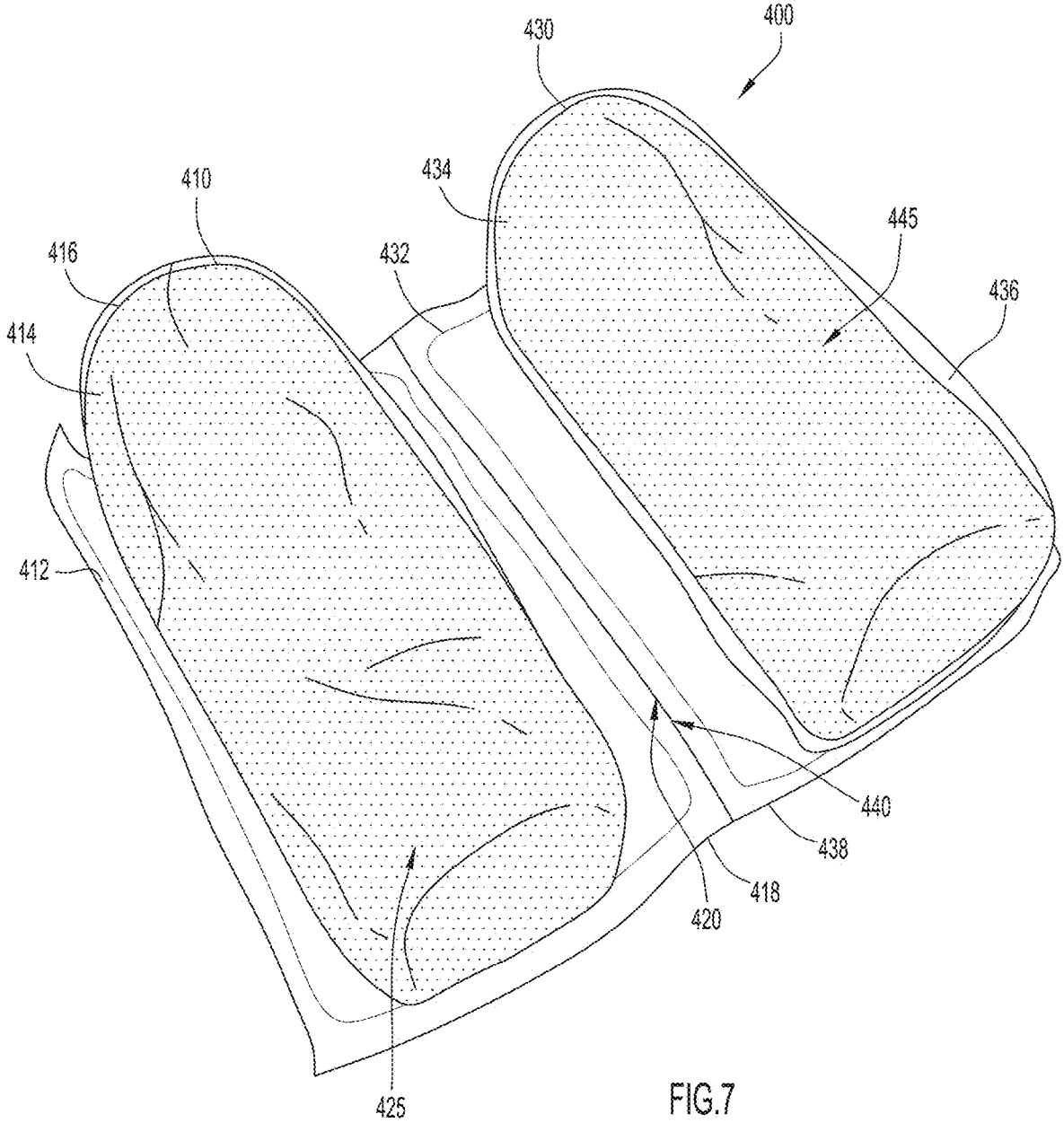
FIG. 7 is a bottom perspective view of another embodiment of a package containing a product.

Referring to FIG. 7, a bottom perspective view of another embodiment of a vacuum sealed package containing a product is illustrated. In this embodiment, the package 400 includes two different portions containing products. In particular, package 400 includes first package portion 410 and second package portion 430, which are individual packages connected to each other. First package portion 410 includes an upper film layer 412 and a lower film layer 414 that collectively define a receptacle 416. First package portion 410 includes a perimeter 418 that extends around the receptacle 416 and that has an outer edge 420. The receptacle 416 has a product 425 therein, which in this example embodiment, is a non-woven product.

Similarly, second package portion 430 includes an upper film layer 432 and a lower film layer 434 that collectively define a receptacle 436. Second package portion 430 includes a perimeter 438 that extends around the receptacle 436 and that has an outer edge 440. The receptacle 436 has a product 445 therein, which is a non-woven product. In one embodiment, the size, shape, and contents of product 425 is the same as the size, shape, and contents of product 445. In an alternative embodiment, the size, shape, and/or contents of product 425 can be different from the size, shape, and/or contents of product 445. Edge 420 is connected to edge 440 via perforations, which can be separated by a user when the user wants to separate first package portion 410 from second package portion 430. When the user breaks the perforations between the first and second package portions 410 and 430, the vacuum seal is maintained on both of the first and second package portions 410 and 430.

Figure 8:
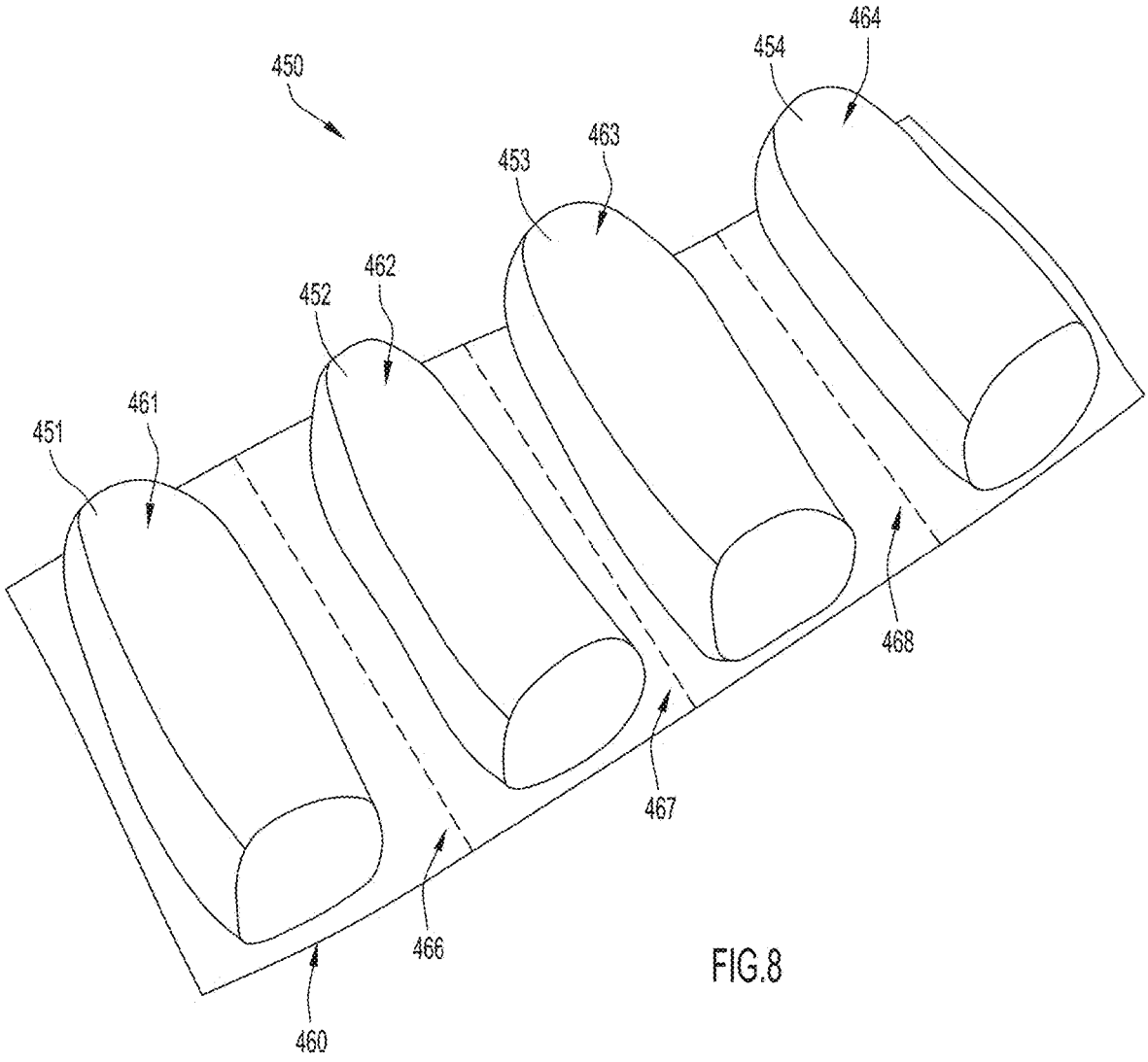
FIG. 8 is a bottom perspective view of another embodiment of a package containing rolled products.

Referring to FIG. 8, a bottom perspective view of another embodiment of a vacuum sealed package with different portions containing products is illustrated. Package 450 includes four different portions containing rolled products. In this embodiment, package 450 includes first package portion 451, a second package portion 452, a third package portion 453, and a fourth package portion 454, each of which is an individual package connected to at least one of the other packages. Package 450 includes a film layer 460 that extends across each of the package portions 451, 452, 453, and 454.

First package portion 451 includes a lower film layer portion 461 that is coupled to film layer 460 to define a receptacle in which a rolled product is located. Second package portion 452 includes a lower film layer portion 462 that is coupled to film layer 460 to define another receptacle in which a rolled product is located. Similarly, third package portion 453 includes a lower film layer portion 463 that is coupled to film layer 460 to define another receptacle in which another rolled product is located. In addition, fourth package portion 454 includes a lower film layer portion 464 that is coupled to film layer 460 to define another receptacle in which another rolled product is located. In one embodiment, each of the lower film layer portions 461, 462, 463, and 464 is part of a continuous lower film layer that is thermoformed to have the multiple receptacles. In another embodiment, each of the lower film layer portions 461, 462, 463, and 464 are separate lower film layers that are each sealed to the film layer 460 to form the various receptacles.

Package 450 includes different sets of perforations 466, 467, and 468 formed in the film layer and film layer portions that are located between different ones of the first package portion 451, the second package portion 452, the third package portion 453, and the fourth package portion 454.

Figure 9:
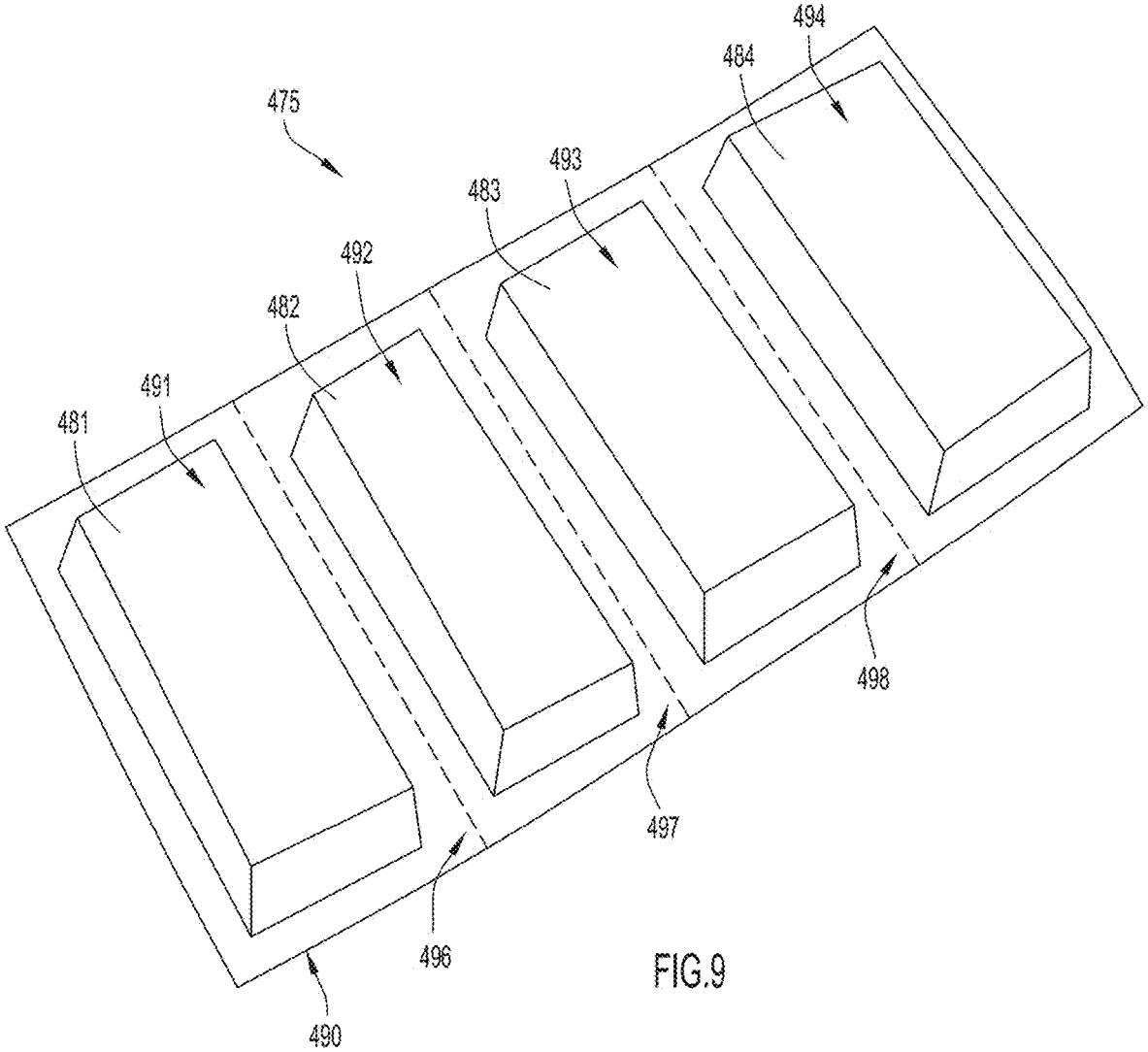
FIG. 9 is a bottom perspective view of another embodiment of a package containing folded products.

Referring to FIG. 9, a bottom perspective view of another embodiment of a vacuum sealed package with different portions containing products is illustrated. In this embodiment, the package 475 includes four different portions containing stacks of flat products. Package 475 includes first package portion 481, a second package portion 482, a third package portion 483, and a fourth package portion 484, each of which is an individual package connected to at least one of the other packages. Other than the shapes of the package portions 481, 482, 483, and 484 and the products contained therein, the structure of package 475 is similar to the structure of package 450 illustrated in FIG. 8.

Package 475 includes a film layer 490 that extends across each of the package portions 481, 482, 483, and 484. First package portion 481 includes a lower film layer portion 491 that is coupled to film layer 490 to define a receptacle in which a flat product stack is located. Similarly, second package portion 482 includes a lower film layer portion 492, third package portion 483 includes a lower film layer portion 483, and fourth package portion 484 includes a lower film layer portion 494. In one embodiment, each of the lower film layer portions 491, 492, 493, and 494 is part of a continuous lower film layer that is thermoformed to have the multiple receptacles. In another embodiment, each of the lower film layer portions 491, 492, 493, and 494 are separate lower film layers that are each sealed to the film layer 490 to form the various receptacles.

Package 475 includes different sets of perforations 496, 497, and 498 formed in the film layer and film layer portions that are located between different ones of the first package portion 481, the second package portion 482, the third package portion 483, and the fourth package portion 484.

Figure 10:
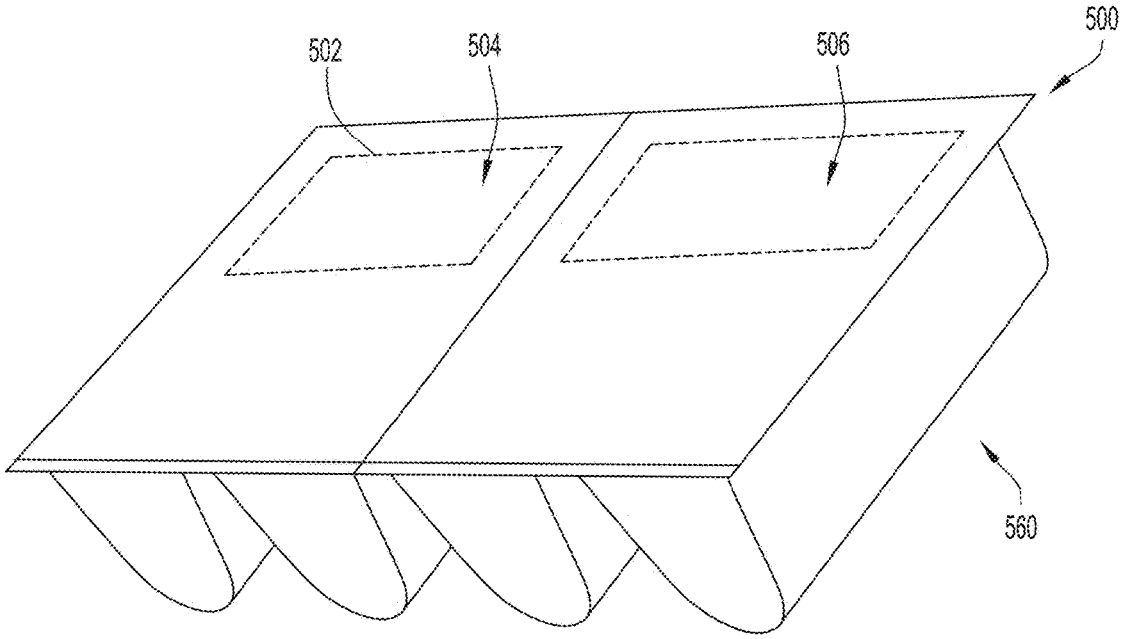
FIG. 10 is a top perspective view of another embodiment of a package containing a product.
Figure 11:
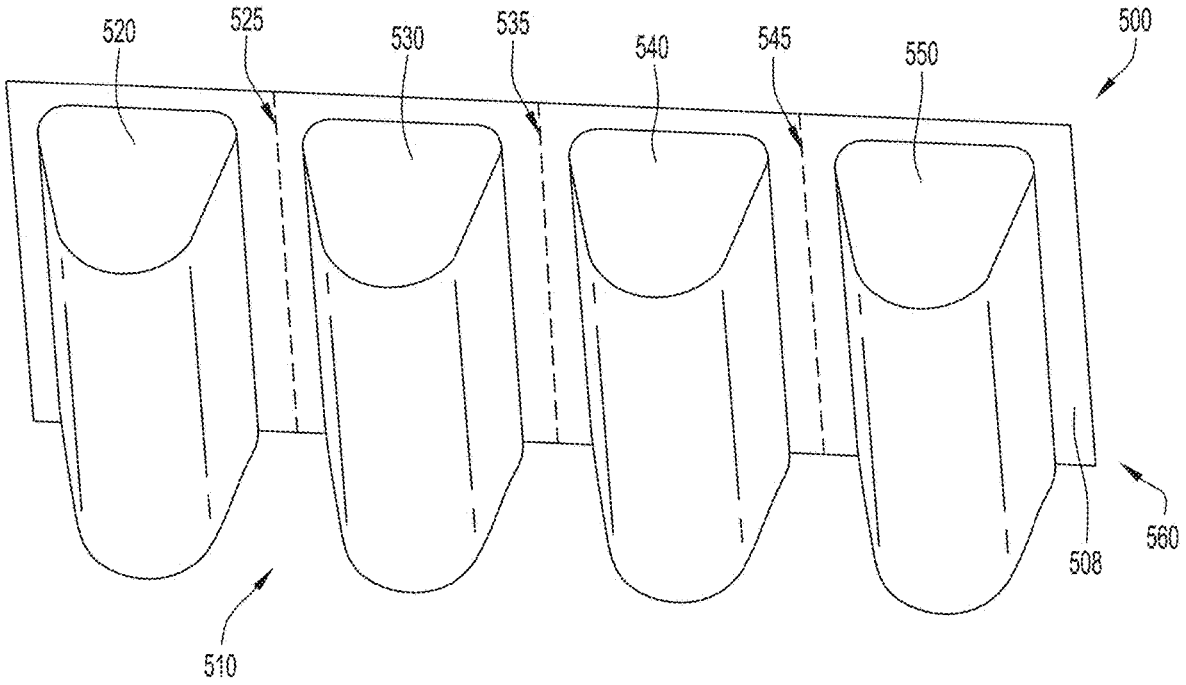
FIG. 11 is a bottom perspective view of the package illustrated in FIG. 10.

Turning to FIGS. 10 and 11, a top perspective view and a bottom perspective view, respectively, of another embodiment of a vacuum sealed package containing a product are illustrated. In this embodiment, the package 500 includes a film layer with an upper surface 502 (see FIG. 10) and a film layer with a lower surface 508 (see FIG. 11). Located on the upper surface 502 are product labels 504 and 506, which relate to the product in the package 500.

Referring to FIG. 11, the package 500 has a lower portion 510 that includes several package portions 520, 530, 540, and 550. Each of the package portions 520, 530, 540, and 550 includes a product, such as a non-woven product, therein. Package portion 520 and package portion 530 are connected to each other by perforations or perforation section 525, which can be broken by a user to separate package portion 520 from package portion 530. Similarly, package portion 530 and package portion 540 are connected to each other by perforations or perforation section 535, and package portion 540 and package portion 550 are connected to each other by perforations or perforation section 545. One or more of the perforation sections 525, 535 or 545 may be broken while maintaining the vacuum seal for any or all of the package portions 520, 530, 540 or 550. The package 500 is illustrated in a configuration 560 in which each of the package portions 520, 530, 540, and 550 is located in the same plane.

Figure 12:
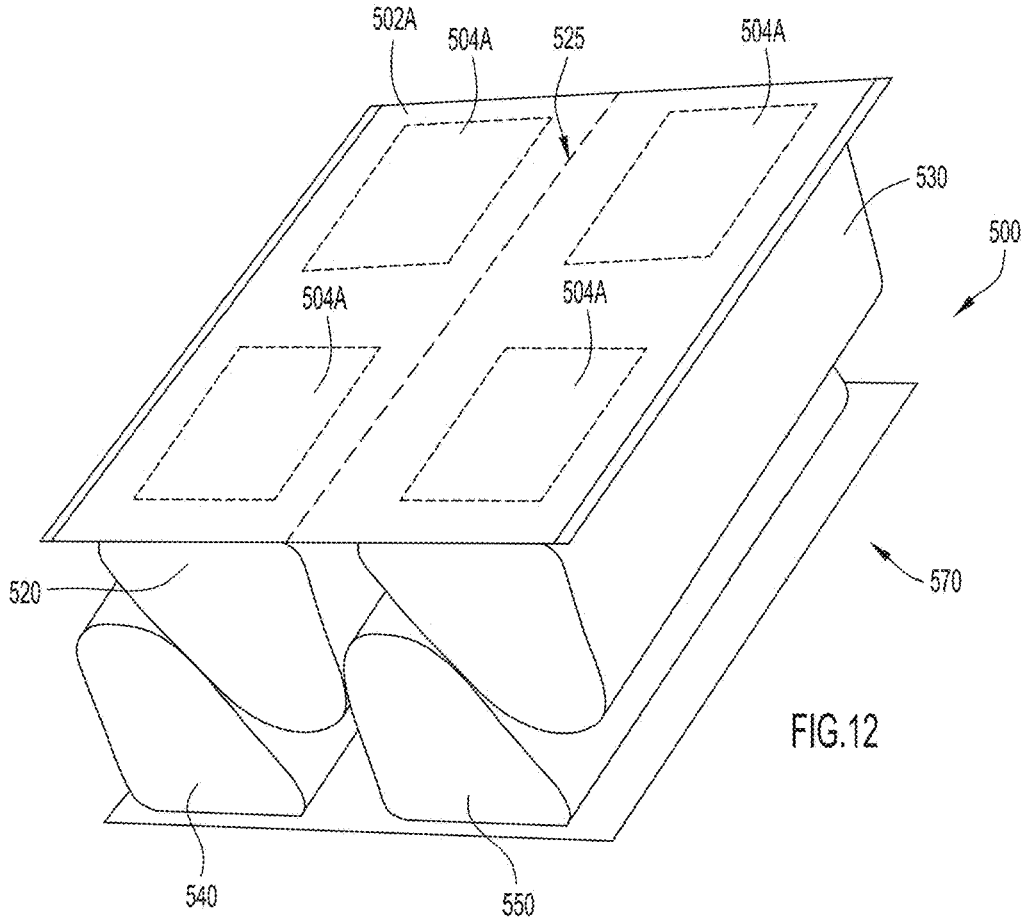
FIG. 12 is a top perspective view of an alternative embodiment of the package illustrated in FIG. 10 in a different configuration.
Figure 13:
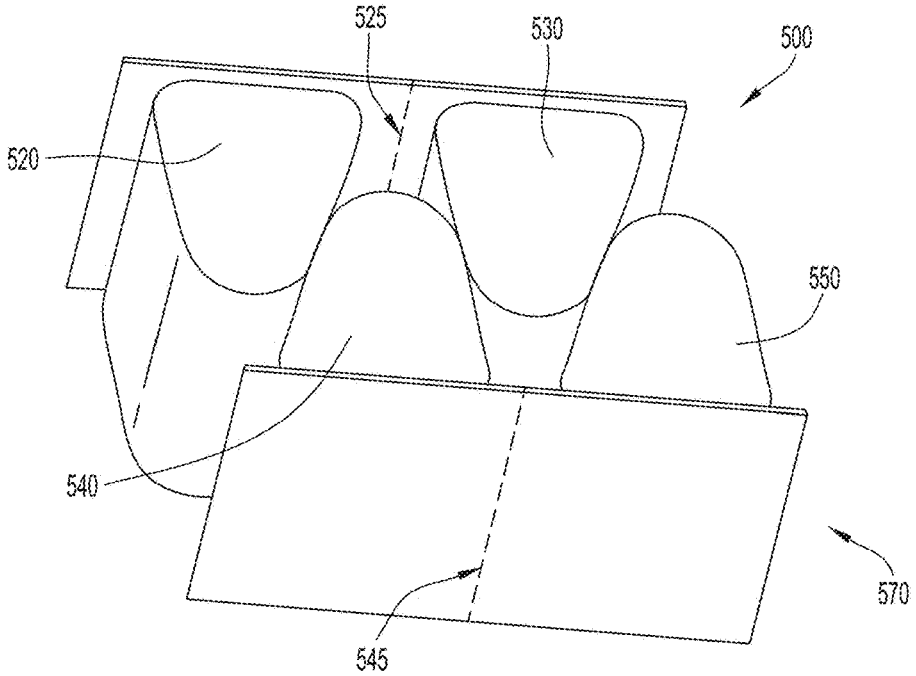
FIG. 13 is a bottom perspective view of the package illustrated in FIG. 12.

Turning to FIGS. 12 and 13, a top perspective view and a bottom perspective view, respectively, of an alternative embodiment of vacuum sealed package 500 in a different configuration are illustrated. In this embodiment, package 500 is shown in a different configuration 570, in which two of the package portions have been separated from two other package portions. Package portions 520 and 530 have been separated from package portions 540 and 550 by a user breaking perforations 535. In this configuration 570, package portions 520 and 530 are still connected by perforations 525 and package portions 540 and 550 are still connected by perforations 545.

As shown best in FIG. 13, the package portions can be moved together so that much of package portion 530 is located between package portions 540 and 550. As a result, the profile of package 500 in configuration 570 is different than the profile of package 500 in configuration 560, which, depending on the container in which the package 500, or the manner in which the package 500 is stored, may be more desirable due to space constraints.

Referring back to FIG. 12, the upper surface 502A of the package 500 in this embodiment has a different arrangement of labels 504A. The orientation and size of the labels of the package 500 can vary.

Figure 14:
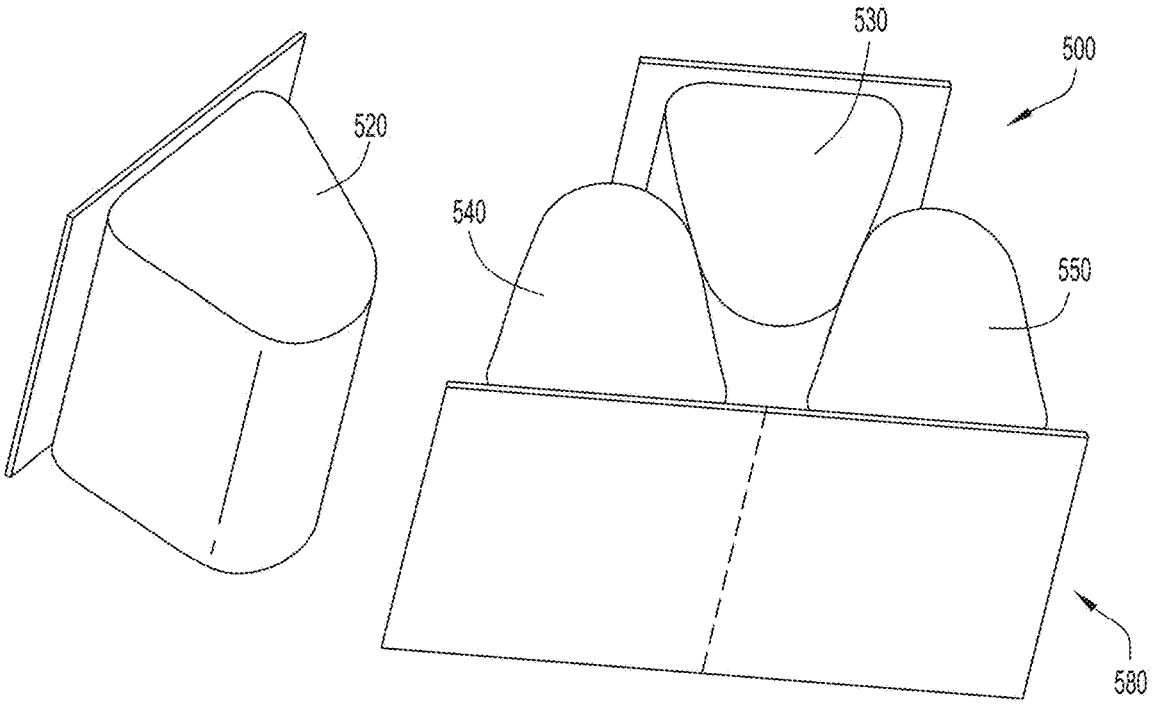
FIG. 14 is a bottom perspective view of the package illustrated in FIG. 10 in yet another configuration.
Figure 15:
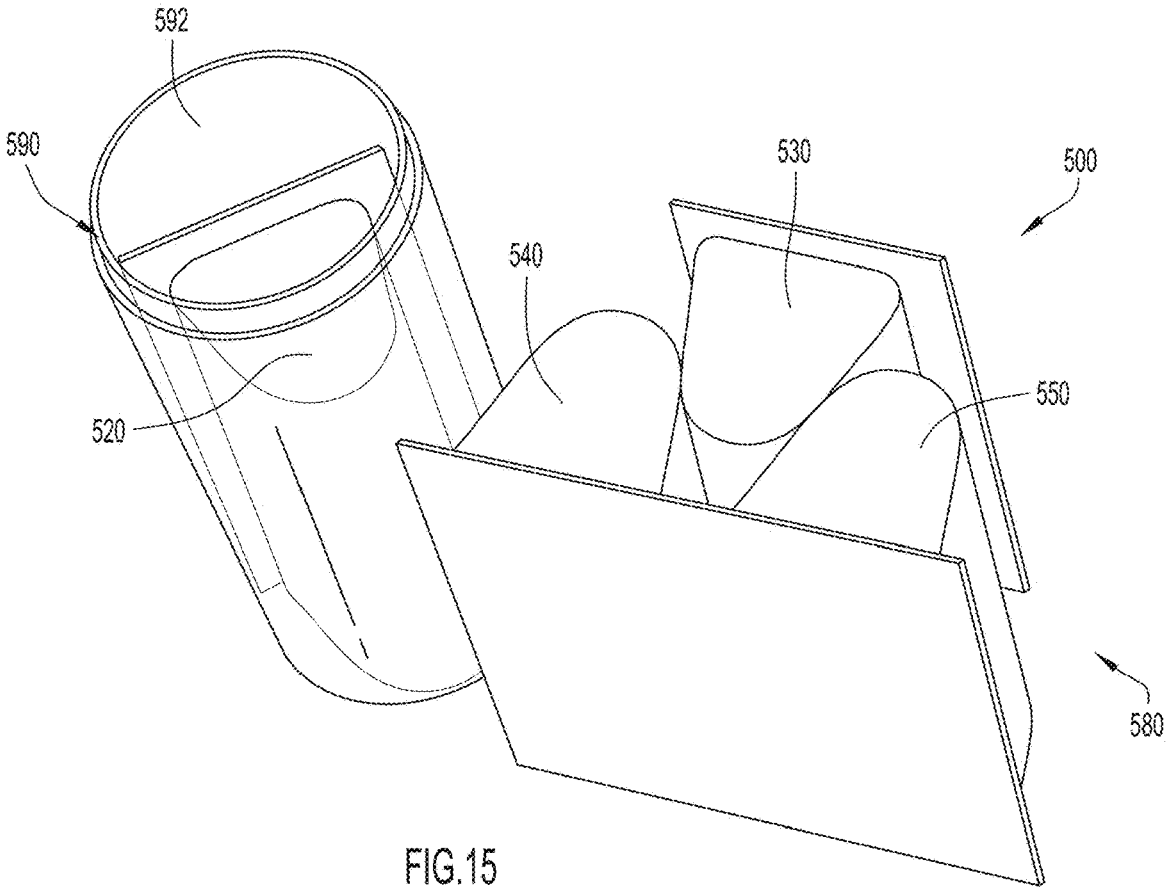
FIG. 15 is a bottom perspective view of the package illustrated in FIG. 10 in yet another configuration.

Turning to FIGS. 14 and 15, bottom perspective views of the vacuum sealed package 500 in a different configuration are illustrated. In this configuration 580, package portion 520 has been separated from package portion 530 by breaking perforations 525. In FIG. 14, package portion 520 is illustrated as being separated from the other package portions. In FIG. 15, the separated package portion 520 has been inserted into a canister 590 that defines a receptacle or cavity 592. The canister 590 can be shipped or transported and/or stored with package portion 520 located therein.

Figure 16:
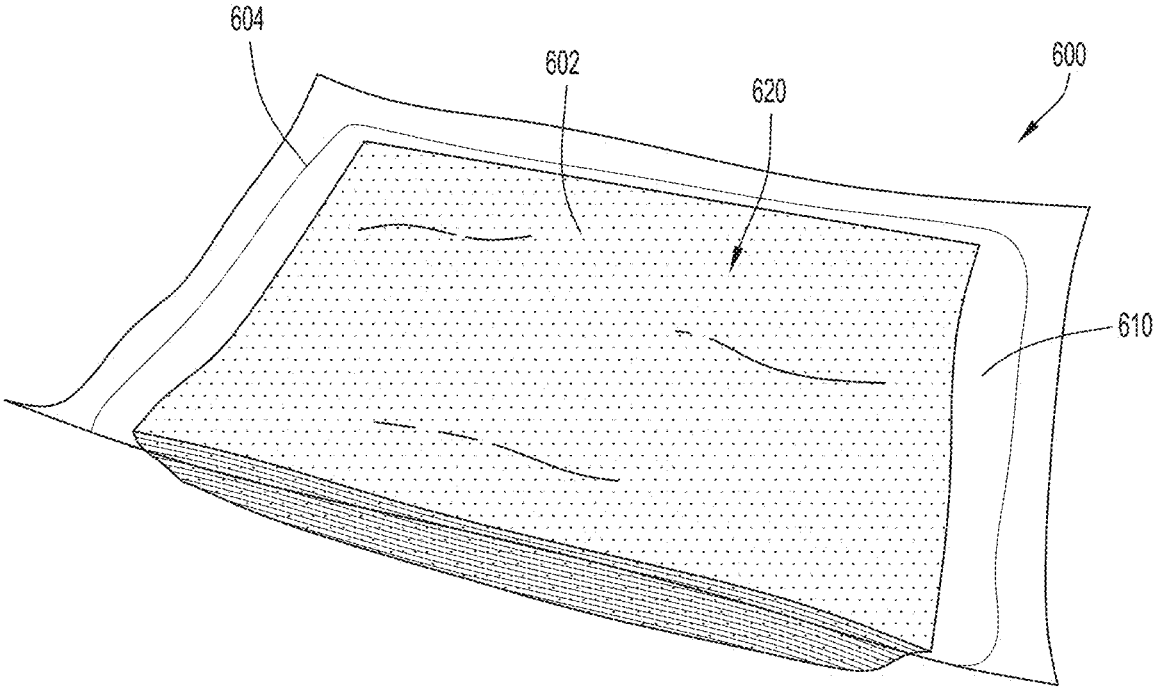
FIG. 16 is a top perspective view of an alternative embodiment of a package containing a folded product.
Figure 17:
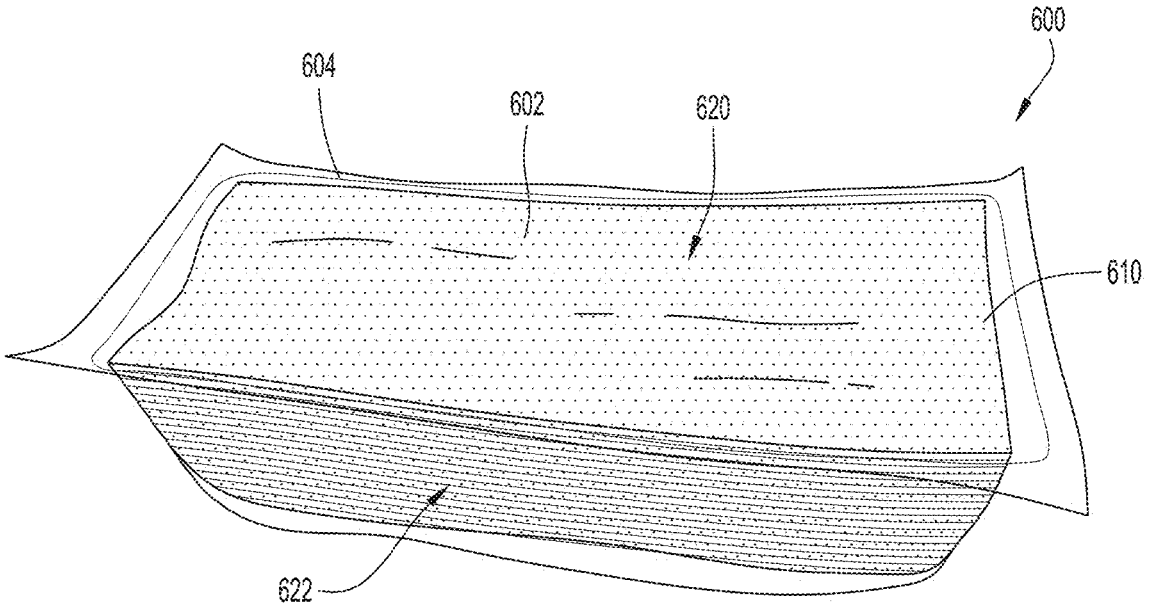
FIG. 17 is another top perspective view of the package illustrated in FIG. 16.

Turning to FIGS. 16 and 17, top perspective views of an alternative embodiment of a vacuum scaled package containing a product are illustrated. In this embodiment, package 600 includes a refill product 620, which is a non-woven product. Instead of having a rolled or cylindrical configuration, refill product 620 is formed in series of aligned layers that are stacked on each other. The package 600 includes a film layer with an upper surface 602 and a lower film layer coupled thereto around a perimeter 604 to form a receptacle 610. In the receptacle 610 is the product 620 in the form of layers 622.

Figure 18:
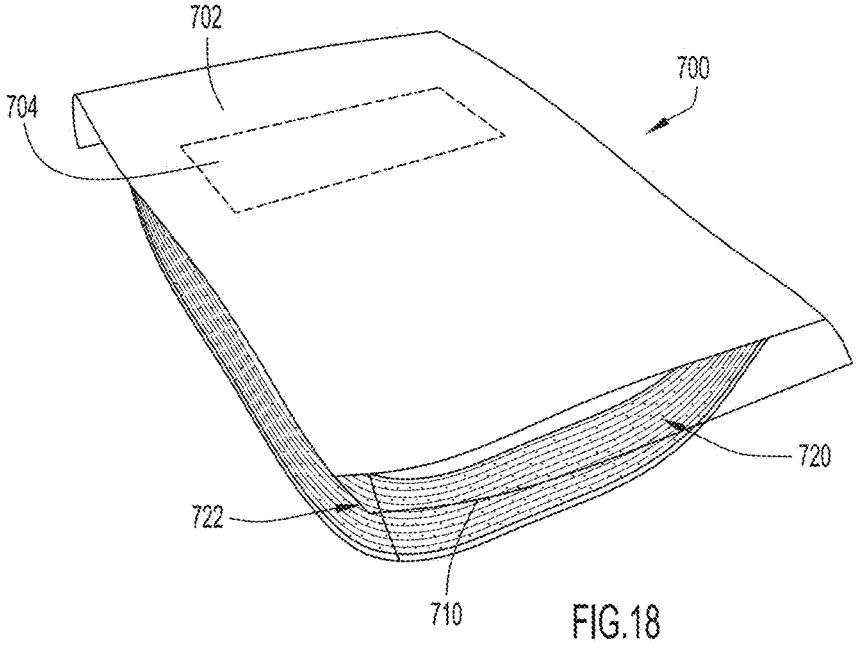
FIG. 18 is a top perspective view of an alternative embodiment of a package containing a folded product.
Figure 19:
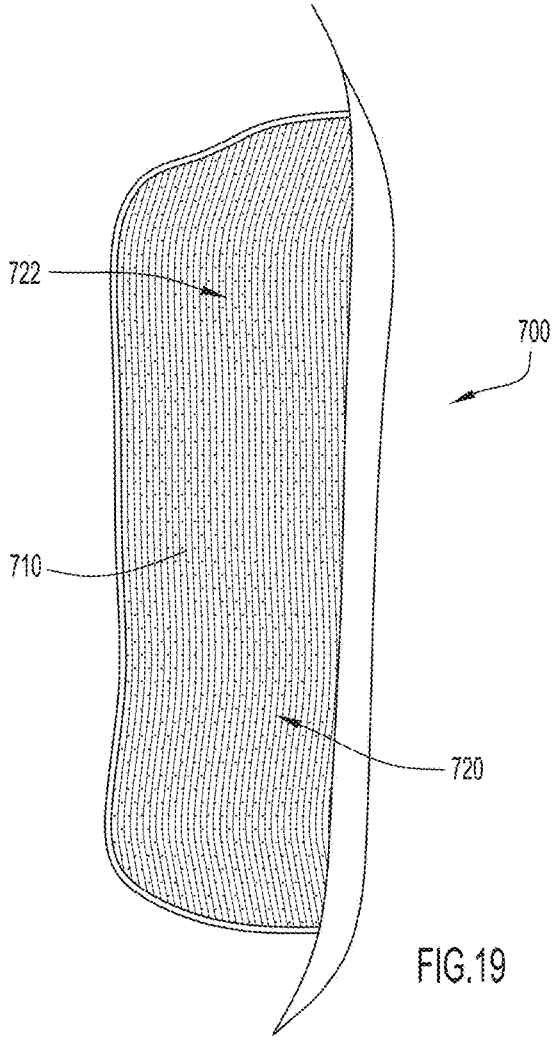
FIG. 19 is a side view of the package illustrated in FIG. 18.
Figure 20:
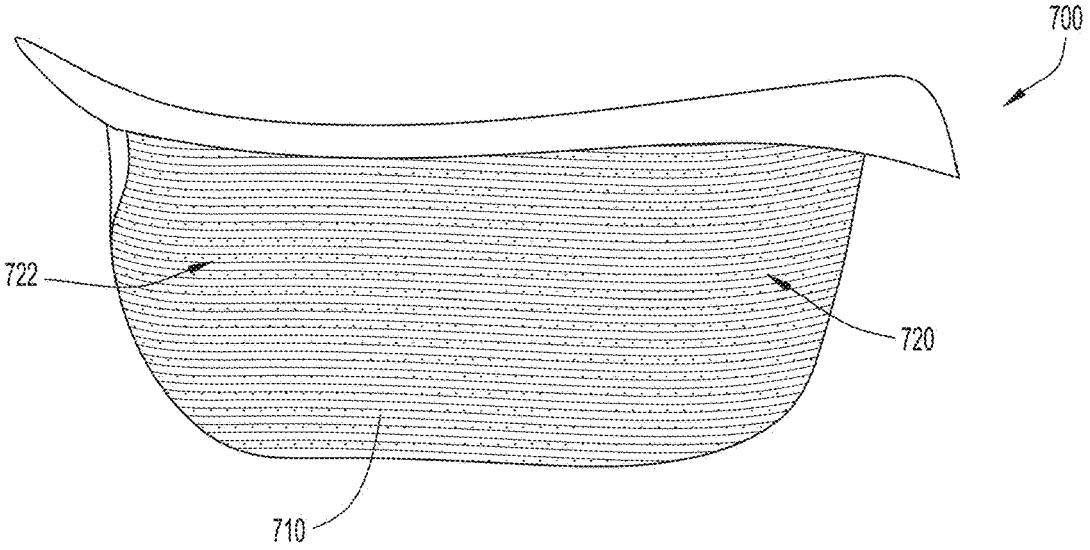
FIG. 20 is an end view of the package illustrated in FIG. 18.
Figure 21:
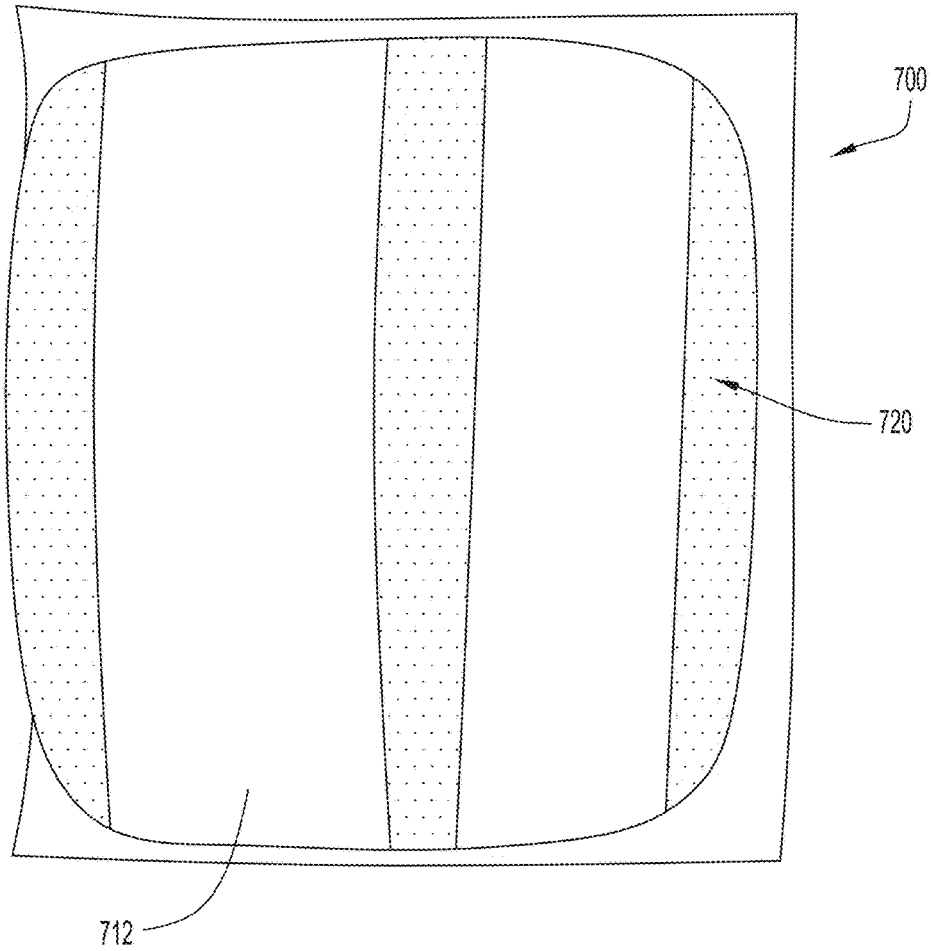
FIG. 21 is a bottom view of the package illustrated in FIG. 18.

Turning to FIGS. 18-21, an alternative embodiment of a vacuum scaled package containing a product are illustrated. Package 700 has a film layer with an upper surface 702 on which a label 704 relating to the product in the package 700 has been printed or applied or coupled. The package 700 has a receptacle 710 in which a product 720, such as a nonwoven product in layers 722, is located. FIG. 18 is a top perspective view of package 700, and FIGS. 19-21 are a side view, an end view, and a bottom view, respectively, of the package 700. As shown in FIG. 21, the package 700 has a bottom surface 712 on which information relating to the product 720 in the package 700 is printed or applied or coupled.

Figure 22:
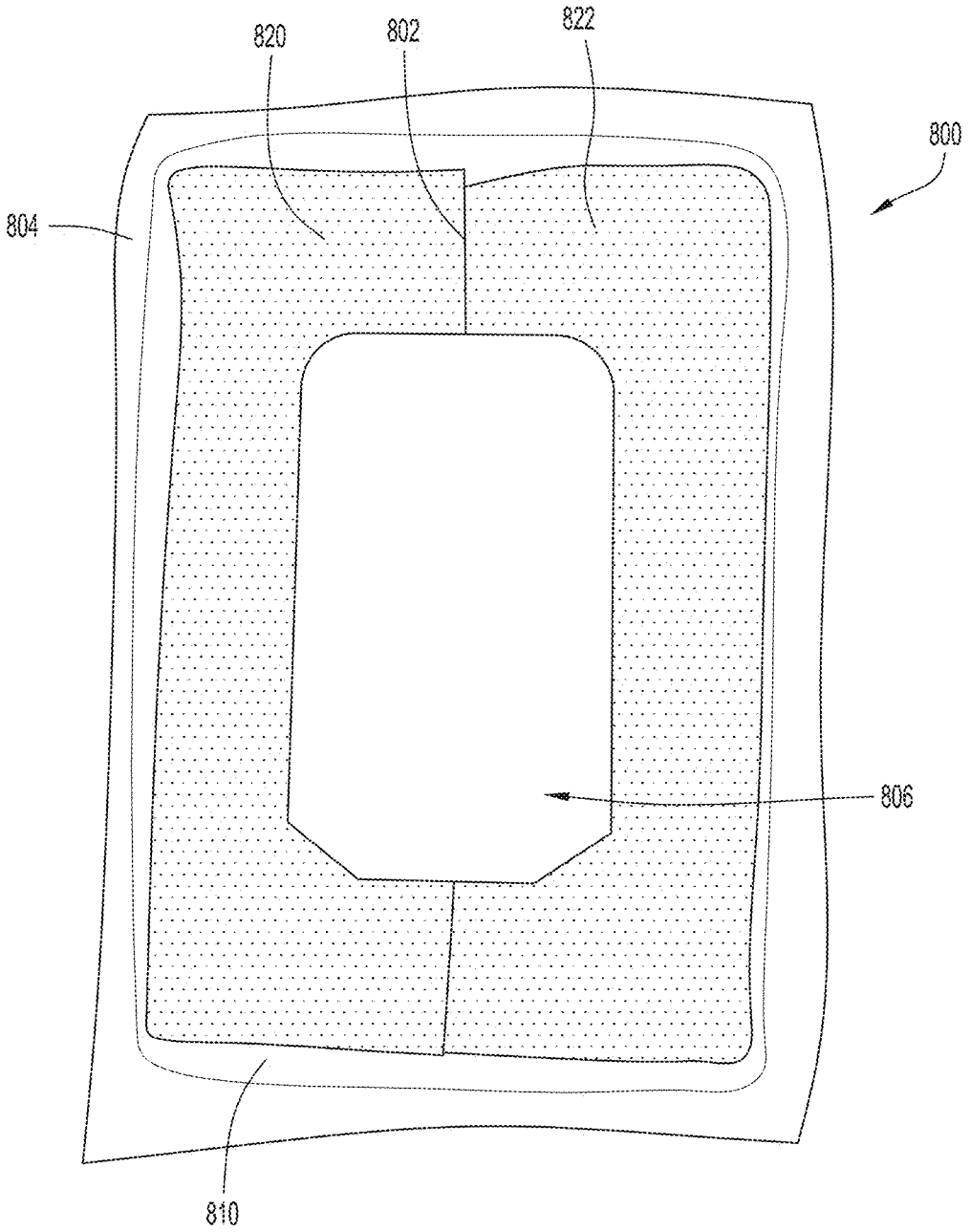
FIG. 22 is a top view of another embodiment of a package containing a product.

Referring to FIG. 22, a top view of another embodiment of a package containing a product is illustrated. Package 800 has a film layer with an upper surface 802 that is coupled to a lower film layer around a perimeter 804. Package 800 has a resealable opening 806 formed in the upper surface 802 that can be opened by a user to take some of the contents in the package 800 through the opening 806. The opening 806 can be rescaled using any conventional technique. Once the seal at opening 806 has been broken, the package will no longer be vacuum scaled, but it still may be resealed to prevent air exposure and/or moisture loss. The opening 806 is in communication with a receptacle 810 in which products are located. Package 800 contains two different groups 820 and 822 of products therein. In one embodiment, the groups 820 and 822 can be the products in rolled configurations in a side-by-side arrangement. In another embodiment, the groups 820 and 822 can be stacks of products in a side-by-side arrangement. A user can take one of the groups 820 and 822 out of the receptacle 810 and reseal the opening 806 so that the other group in the receptacle 810 does not dry out.

Figure 23:
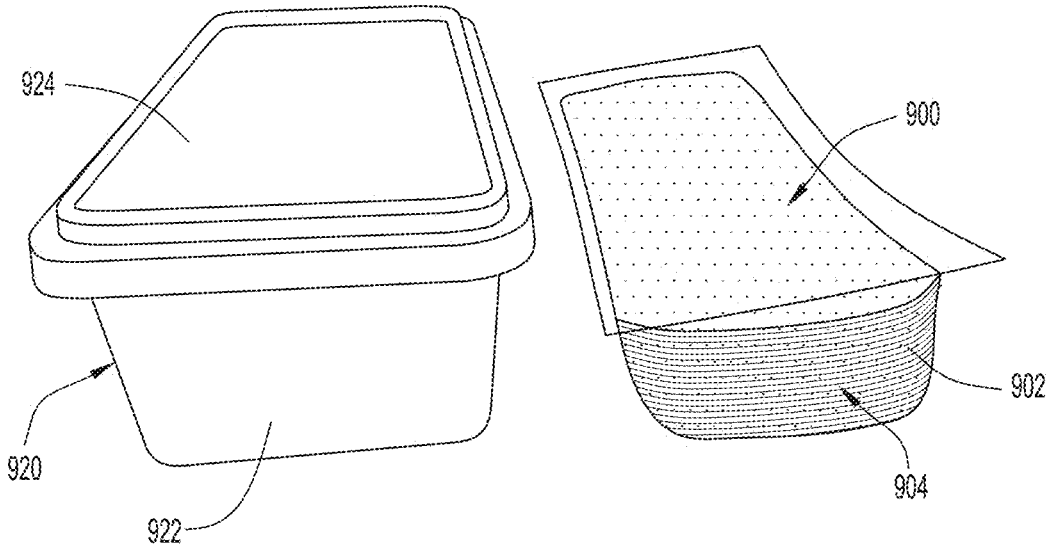
FIG. 23 is a perspective view of another embodiment of a package containing a product and a container.

Referring to FIG. 23, a perspective view of another embodiment of a package containing a product and a container is illustrated. Package 900 includes a receptacle 902 in which a product 904 is located. In this embodiment, the product 904 is a layered stack of disinfecting wipe mopping cloths. The package 900 including product 904 can be placed into a receptacle of a container 920, which includes a body 922 and a removable lid 924. Alternatively, the layers of the product 904 can be removed from the package 900 and placed into the receptacle of container 920. The lid 924 can be placed onto the body 922 to preserve the characteristics of the product 904.

Figure 24:
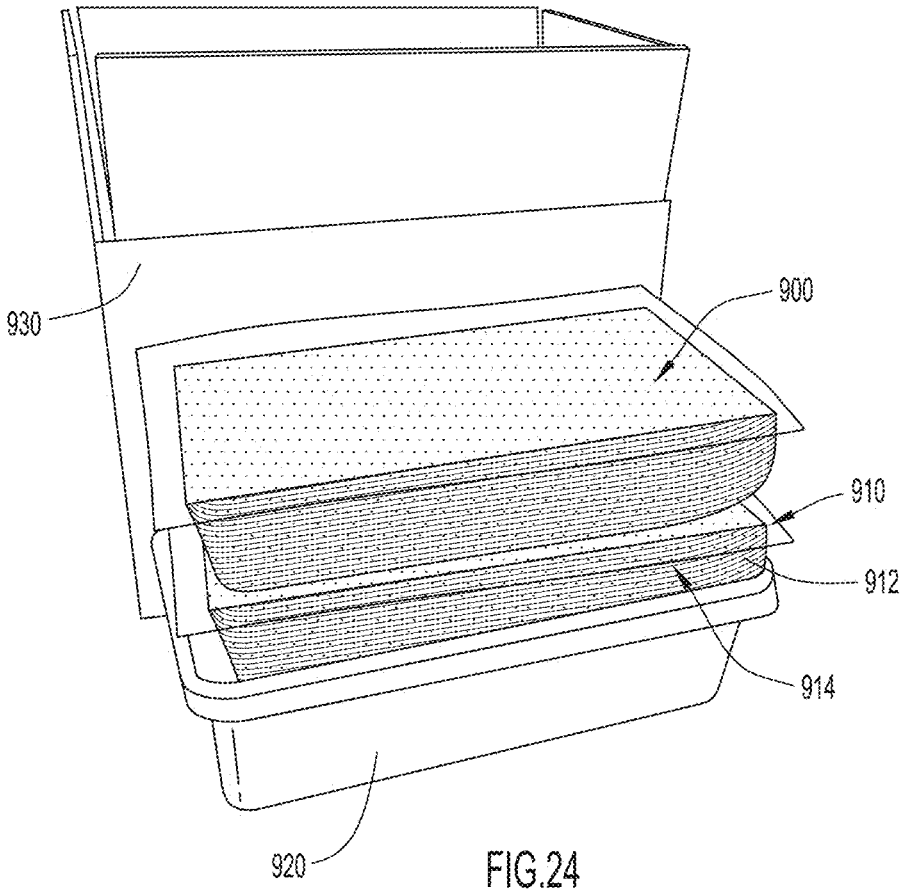
FIG. 24 is a perspective view of the package and container illustrated in FIG. 23, along with an additional package and container.

Turning to FIG. 24, a perspective view of the package 900 and container 920 in combination with another package 910 is illustrated. Similar to package 900, package 910 has a receptacle 912 in which product 914 is located. The container 920 along with packages 900 and 910 can be placed into a cavity of shipping container 930 in the configuration illustrated in FIG. 24. In an alternative embodiment, another package containing product can be placed into container 920 prior to packages 900 and 910 and container 920 being inserted into shipping container 930.

Like numbers refer to like elements throughout. The terminology used herein is for the purpose of describing particular embodiments only and is not intended to be limiting of the invention. Unless otherwise defined, all terms used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art. Well-known functions or constructions may not be described in detail for brevity and/or clarity.

As used herein, the singular forms "a," "an," and "the" are intended to include the plural forms as well, unless the context clearly indicates otherwise. The terms "comprises" and/or "comprising," when used in this specification, specify the presence of stated features, steps, operations, elements, and/or components, but do not preclude the presence or addition of one or more other features, steps, operations, elements, components, and/or groups thereof. As used herein, the term "and/or" includes any and all combinations of one or more of the associated listed items. As used herein, phrases such as "between X and Y" and "between about X and Y" should be interpreted to include X and Y, phrases such as "between about X and Y" mean "between about X and about Y," and phrases such as "from about X to Y" mean "from about X to about Y."

It will be understood that when an element is referred to as being "on," "attached" to, "connected" to, "coupled" with, "contacting", etc., another element, it can be directly on, attached to, connected to, coupled with or contacting the other element or intervening elements may also be present. In contrast, when an element is referred to as being, for example, "directly on", "directly attached" to, "directly connected" to, "directly coupled" with or "directly contacting" another element, there are no intervening elements present. Also, references to a structure or feature that is disposed "adjacent" another feature may have portions that overlap or underlie the adjacent feature.

Spatially relative terms, such as "under," "below," "lower," "over," "upper," "lateral," "left," "right" and the like, may be used herein for ease of description to describe one element's or feature's relationship to another element or feature as illustrated in the figures. Spatially relative terms are intended to encompass different orientations of the disclosed structure in use or operation in addition to the orientation depicted in the figures. For example, if the structure in the figures is inverted, elements described as "under" or "beneath" other elements or features would then be oriented "over" the other elements or features. The device may be otherwise oriented (such as rotated 90 degrees) and the descriptors of relative spatial relationships used herein interpreted accordingly.

As used herein, the terms "alternative," example," "exemplary," and derivatives thereof are intended to refer to non-limiting examples and/or variants embodiments discussed herein, and are not intended to indicate preference for one or more embodiments compared to other embodiments. The invention being thus described, it will be apparent that the same may be varied in many ways. Such variations are not to be regarded as a departure from the spirit and scope of the invention, and all such modifications as would be obvious to one skilled in the art are to be included within the scope of the following claims.

What is claimed is:

1. A flexible package, comprising:

a first body defining a first cavity under vacuum pressure of about 5 to 800 mbar at room temperature, the first body includes a first material layer and a second material layer, the first material layer being thermoformed to define the first cavity, the first body having a seal;

a first product disposed in the first cavity, the first product containing multiple nonwoven substrates, the first product is one of a fibrous web or a continuous nonwoven product, the first product being a first roll of disinfecting and/or cleaning wipes;

a first formula being a first liquid disposed in the first cavity with the multiple nonwoven substrates, wherein the seal of the first body can be opened to access the first product and the first formula;

a second body defining a second cavity, the second body includes a third material layer and a fourth material layer, the second body having a seal;

a second product disposed in the second cavity, the second product containing multiple nonwoven substrates, the second product is one of a fibrous web or a continuous nonwoven product, the second product being a second roll of disinfecting and/or cleaning wipes; and a second formula being a second liquid disposed in the second cavity with the multiple nonwoven substrates, wherein the seal of the second body can be opened to access the second product and the second formula, and the first body and the second body are connected to each other with perforations.

2. The flexible package of claim 1, wherein the first roll and the first formula can be removed from the first cavity of the first body and subsequently inserted into a receptacle of a canister to refill the canister with the first roll and the first formula.

3. The flexible package of claim 1, wherein the first body containing the first product and the first formula can be inserted into a receptacle of a canister and transported therewith.

4. The flexible package of claim 1, wherein each of the first body and the second body is a thermoform-shaped film package.

5. The flexible package of claim 4, wherein the first body has a first edge, the second body has a second edge, the second edge is connected to the first edge by the perforations, and the perforations can be separated by a user.

6. The flexible package of claim 1, wherein the third material layer of the second body is thermoformed to define the second cavity.

7. The flexible package of claim 1, wherein the second cavity of the second body is under vacuum pressure of about 5 to 800 mbar at room temperature.

8. A flexible package, comprising:

a first body defining a first cavity under vacuum pressure of about 5 to 800 mbar at room temperature, the first body having a seal, the first body being a thermoform-shaped film package that defines the first cavity;

a first product disposed in the first cavity wherein the first product contains multiple nonwoven substrates, the first product being one of a fibrous web or a continuous nonwoven product, the first product being a first roll of disinfecting and/or cleaning wipes;

a first formula disposed in the first cavity with the multiple nonwoven substrates, the first formula being a first liquid;

a second body defining a second cavity under vacuum pressure of about 5 to 800 mbar at room temperature, the second body having a seal, the second body being a thermoform-shaped film package that defines the second cavity;

a second product that contains multiple nonwoven substrates disposed in the second cavity of the second body, the second product being one of a fibrous web or a continuous nonwoven product, the second product being a second roll of disinfecting and/or cleaning wipes; and a second formula disposed in the second cavity of the second body, the second formula being a second liquid, wherein the seal of the first body or the second body can be opened to access the first product and the first formula or the second product and the second formula, respectively, and the first body and the second body are connected to each other with perforations that can be separated by a user.

9. The flexible package of claim 8, wherein the first body has a first edge, the second body has a second edge, and the second edge is connected to the first edge by the perforations.

10. The flexible package of claim 8, wherein the first product and the first liquid can be removed from the first cavity of the first body and subsequently inserted into a receptacle of a canister to refill the canister with the first product and the first liquid.

11. The flexible package of claim 8, wherein the first body containing the first product and the first liquid can be inserted into a receptacle of a canister and transported therewith.

12. A package of a first product and a second product, the package comprising:

a first package portion including:

a first body defining a first cavity under vacuum pressure of about 100 to 800 mbar at room temperature, the first body having a first perimeter extending around the first body, the first body having a first seal extending around the first perimeter; and a first product and a first formula, each of the first product and the first formula disposed in the first cavity, the first seal being openable to access the first product and the first formula, the first product is one of a fibrous web or a continuous nonwoven product, the first product is a first roll of disinfecting and/or cleaning wipes, the first formula being a first liquid; and a second package portion including:

a second body defining a second cavity under vacuum pressure, the second body having a second perimeter extending around the second body, the second body having a second seal extending around the second perimeter; and a second product and a second formula, each of the second product and the second formula disposed in the second cavity, the second seal being openable to access the second product and the second formula, the second product is one of a fibrous web or a continuous nonwoven product, the second product is a second roll of disinfecting and/or cleaning wipes, the second formula being a second liquid, wherein the second package portion is connected to the first package portion via perforations that can be separated by a user, and one of the first seal or the second seal can be opened without opening the other of the first seal or the second seal.

13. The package of claim 12, wherein each of the first body and the second body is a thermoform-shaped film package.

14. The package of claim 12, wherein the first body includes a first material layer and a second material layer, the first material layer being thermoformed to define the first cavity.

15. The package of claim 12, wherein the first body has a first edge, the second body has a second edge, and the second edge is connected to the first edge by the perforations.

16. The package of claim 12, wherein the first roll of disinfecting and/or cleaning wipes and the first liquid can be removed from the first cavity of the first body and subsequently inserted into a receptacle of a canister to refill the canister with the first roll and the first liquid.

17. The package of claim 12, wherein the first body containing the first product and the first liquid can be inserted into a receptacle of a canister and transported therewith.

* * * * *